US005829648A

United States Patent [19]

Goeren et al.

[11] Patent Number: 5,829,648

[45] Date of Patent: Nov. 3, 1998

[54] SHEET SPRAY AND SPRAYER WITH BEADS

[75] Inventors: Neil Goeren, New Albany; Beth Pritchard, Reynoldsburg, both of Ohio

[73] Assignee: Bath & Body Works, Inc., Reynoldsburg, Ohio

[21] Appl. No.: 786,241

[22] Filed: Jan. 21, 1997

[51] Int. Cl.[6] ..... A63H 5/00

[52] U.S. Cl. ..... 222/321.7; 222/154; 222/383.1; 222/402.1; 446/419; 239/142; 239/289; 239/337; 239/DIG. 5; 366/130; 366/342

[58] Field of Search ..... 222/23, 39, 154, 222/158, 159, 321.7, 383.1, 402.1, 383.2–385; 239/142, 289, 337, DIG. 5, DIG. 14; 366/130, 342; 446/419

[56] References Cited

U.S. PATENT DOCUMENTS

| | | | |
|---|---|---|---|
| 2,580,132 | 12/1951 | Seymour | 366/130 |
| 2,774,628 | 12/1956 | Engstrum | 222/402.1 |
| 3,087,707 | 4/1963 | Moonan | 366/130 |
| 3,119,528 | 1/1964 | Dunning, Jr. | 222/402.1 |
| 3,184,118 | 5/1965 | Webster | 239/337 |
| 4,415,099 | 11/1983 | Paris | 222/402.1 |
| 4,640,623 | 2/1987 | Tornell | 366/342 |
| 4,641,974 | 2/1987 | Church | 366/342 |
| 5,060,823 | 10/1991 | Perlman | 222/402.1 |
| 5,236,262 | 8/1993 | Espey | 366/130 |

*Primary Examiner*—J. Casimer Jacyna
*Attorney, Agent, or Firm*—Notaro & Michalos P.C.

[57] ABSTRACT

An apparatus for use by a user to entertain the user and to dispense a fragrance includes a container made of plastic which contains a colorless or lightly tinted liquid and about 2 to 6 beads of hard plastic or glass. The user shakes the container to produce a pleasing vibration and sound and actuates a spray pump to spray the liquid onto bedding or other household objects to spread a fragrance which is contained in the liquid.

10 Claims, 1 Drawing Sheet

SHEET SPRAY AND SPRAYER WITH BEADS

FIELD AND BACKGROUND OF THE INVENTION

The present invention relates, in general, to air freshening, and in particular to a new and useful apparatus and method which, in addition to affecting the aroma of household areas and materials, such as bedding, also has an advantageous psychological affect.

A recently emerging field known as "Aromatherapy", explores the beneficial psychological, and resulting physical advantages which may be achieved by exposing an individual to pleasant aromas and mixtures of aromas.

An object of the present invention is to provide a user with an apparatus and technique which uses the benefits of Aromatherapy and other sensory inputs including sound and touch, to entertain and improve the psychological condition of the user.

SUMMARY OF THE INVENTION

Accordingly, an object of the present invention is to provide an apparatus for use by a user to entertain the user and dispense a fragrance, comprising: a container; a liquid containing a scent in the container; spray means connected to the container for spraying the liquid from the container; and at least one hard bead in the container, the bead being non-soluble in the liquid and being dimensioned so that the bead bounces against interior walls of the container when the container is shaken by the user, to generate sounds and vibrations which are sensed by the user, and which, with the aroma also sensed by the user, entertains the user.

Another object of the present invention is to provide a method for entertaining a user and for improving a psychological condition of the user, comprising providing a container containing a liquid with a scent and a spray mechanism for spraying the liquid from the container, the container containing at least one, but preferably a plurality of hard beads which do not dissolve in the liquid, activating the spray mechanism for spraying the liquid into the air or onto a surface for applying the scent to the air or to the surface, and shaking the container to cause the beads to bounce against the inner wall surfaces of the container to generate sound and vibration.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
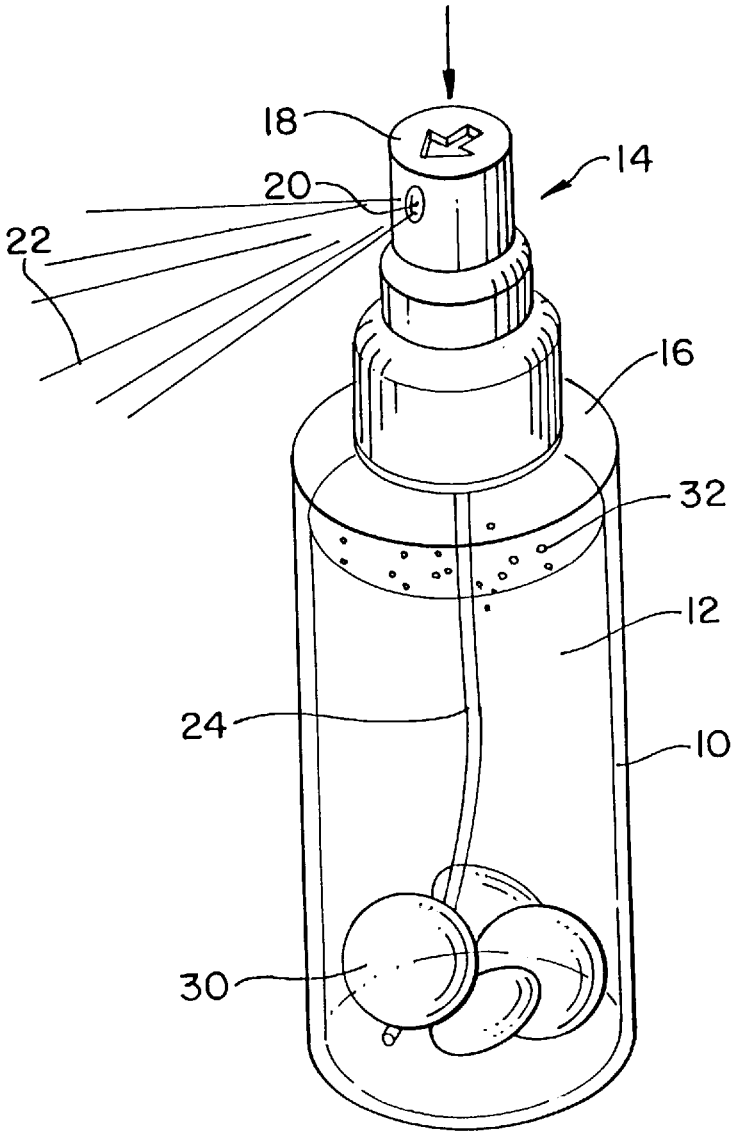
FIG. 1 is a prospective view of the apparatus of the present invention.

Referring to the drawings in particular, the invention embodied in FIG. 1 comprises in apparatus which can entertain a user and which may improve the psychological condition of the user comprising a container 10 advantageously made of transparent plastic such as PVC or other rigid but resilient elastomer containing a non-staining liquid 12 which is clear and either colorless or at most has a very light tint, perhaps in the blue family, and which contains a small concentration of scent or fragrance. Liquid 12 is advantageously water with from about 0.001 to 0.1 percent by weight fragrance such as aromatic oils which are dispersed in the liquid or dissolved in the liquid.

A spray mechanism generally designated 14 is connected, for example by threads, to the upperwardly open neck of the container 10 which extends above a shoulder 16 of the container. Spray mechanism 14 includes a pump actuator 18 of conventional design having an upper surface which can be pressed by the finger of the user for spraying the liquid 12 through a small pin hole 20 into a blossom of spray 22. In known fashion, the liquid is siphoned through a spray pipe 24 and discharged through the blunt aperture 20 to form the conical spray 22.

In use, the liquid can be sprayed directly onto bedding such as sheets and pillows to improve the scent of the bedding without staining or otherwise damaging the bedding. The spray is sufficiently dispersed so that the bedding is also not overly wet by the spray.

Figure 2:
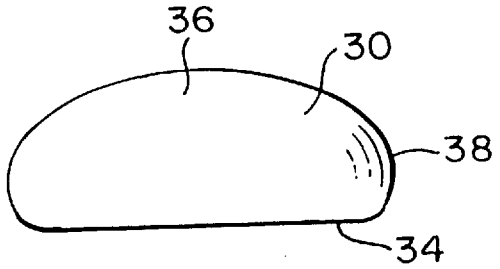
FIG. 2 is a side elevational view of a hard bead for use with the present invention.

A plurality, for example between about 2 and 6 beads or marbles 30 of hard material which does not dissolve in the liquid 12, are also placed in the container. The relative diameter between the container and the beads is such that the beads can freely move around within the container advantageously during use. The user will shake the container, perhaps producing a light foam or light froth 32 and, causing the beads 30 to bounce against the interior plastic walls of the container 10, producing sound and vibrations which can be heard and felt by the user. This, in conjunction with the pleasant scent, will entertain and advantageously affect the user in a positive way. The beads may be made of any hard substance such as glass, PVC, ABS or other synthetic or natural material. Advantageously the beads are transparent or translucent and have a color such as blue or green, which contrast or complements the colorless or lightly tinted color of the liquid 12. As shown in FIG. 2, beads 30 are advantageously lozenged shaped. For the purpose of this disclosure, the term lozenge shaped is meant to describe a non-spherical bead which for example has a flat or flattened bottom 34, a domed top 36 and a circular circumference 38.

Figure 3:
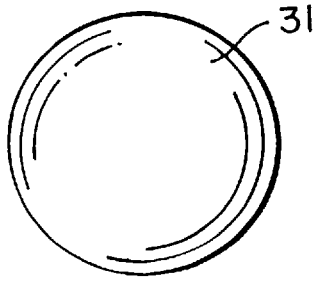
FIG. 3 is a side elevational view of another embodiment for a bead or marble, for use with the present invention.

As shown in FIG. 3, the beads or marbles may alternatively be spherical marbles 31. Although advantageously translucent or transparent and brightly colored, the marbles may also be opaque and differently colored, for example dark brown or black. It is preferred however that the marbles be transparent and brightly colored.

Advantageously the container should be of a size to fit in the hand and may have a round or oval diameter of about 1¾ inches (about 1 to 4 inches across) and 3¾ inches tall to the shoulder (about 2 to 8 inches to the shoulder) and approximately 5½ inches to the top of actuator 18. The beads are advantageously ¾ of an inch in diameter and ¼ of an inch tall in the embodiment of FIG. 2 and of a diameter from ½ to 1 inch in either lozenge shape or spherical.

The bottle wall thickness should be approximately 0.03 inches and advantageously in the range of about 0.005 to 0.07 inches. Sufficient wall thickness is necessary so that the bottle is self supporting and thick enough to produce a pleasant bouncing affect when the beads are bounced against the inner surfaces of the bottle.

While a specific embodiment of the invention has been shown and described in detail to illustrate the application of the principles of the invention, it will be understood that the invention may be embodied otherwise without departing from such principles.

What is claimed is:

1. An apparatus for use by a user to entertain the user and dispense a fragrance, comprising:

a plastic container which is rigid and resilient for producing a sound and vibration when at least one hard bead bounces against interior walls of the container;

a non-staining transparent liquid containing 0.001 to 0.1 percent by weight fragrance in the container;

a manual spray activator with spray pipe and pin hole connected to the container for pumping and spraying the liquid from the container by siphoning the liquid through the spray pipe and from the pin hole; and a plurality of colored hard beads in the container, the beads being non-soluble in the liquid and being dimensioned so that the beads bounce against interior walls of the container when the container is shaken by the user, to generate sounds and vibrations which are sensed by the user, and which, with the aroma of the liquid also sensed by the user, entertains the user.

2. An apparatus according to claim 1 including from two to about six beads in the bottle.

3. An apparatus according to claim 1 wherein the beads are translucent.

4. An apparatus according to claim 1 wherein the container is transparent.

5. An apparatus according to claim 4 wherein the container is round or with a diameter of about 1 to 4 inches and a height of about 2 to 8 inches, at least one bead having a diameter of about ½ to 1 inch.

6. An apparatus according to claim 5 wherein the container has a wall thickness of about 0.005 to about 0.07 inches.

7. An apparatus according to claims 1 wherein the beads are transparent.

8. An apparatus according to claim 1 including wherein the beads are lozenge shaped.

9. An apparatus according to claim 8 wherein the beads are from about ½ to about 1 inch in diameter.

10. An apparatus according to claim 1 wherein the liquid is colorless.

* * * * *